US010458299B2

(12) United States Patent
Hillen et al.

(10) Patent No.: US 10,458,299 B2
(45) Date of Patent: Oct. 29, 2019

(54) EXHAUST GAS AFTERTREATMENT APPARATUS

(71) Applicant: INNIO Jenbacher GmbH & Co OG, Jenbach (AT)

(72) Inventors: Friedhelm Hillen, Jenbach (AT); Arne Bienholz, Darmstadt (DE); Bhuvaneswaran Manickam, Rattenberg (AT); Marco Dris Paul, Innsbruck (AT)

(73) Assignee: INNIO Jenbacher GmbH & Co OG, Jenbach (AT)

( * ) Notice: Subject to any disclaimer, the term of this patent is extended or adjusted under 35 U.S.C. 154(b) by 0 days.

(21) Appl. No.: 14/788,986

(22) Filed: Jul. 1, 2015

(65) Prior Publication Data

US 2016/0017779 A1 Jan. 21, 2016

(30) Foreign Application Priority Data

Jul. 21, 2014 (AT) ..... A 572/2014

(51) Int. Cl.

| | |
|---|---|
| ***F01N 3/20*** | (2006.01) |
| ***F01N 3/08*** | (2006.01) |
| ***F01N 13/10*** | (2010.01) |
| ***F01N 13/00*** | (2010.01) |

(52) U.S. Cl.

CPC ..... *F01N 3/20* (2013.01); *F01N 3/08* (2013.01); *F01N 13/017* (2014.06); *F01N 13/107* (2013.01); *F01N 2410/00* (2013.01); *F01N 2470/16* (2013.01); *F01N 2590/10* (2013.01)

(58) Field of Classification Search

CPC ..... F01N 3/20; F01N 13/017; F01N 2470/16; F01N 2410/00; F01N 13/107; F01N 3/08; F01N 2590/10

See application file for complete search history.

(56) References Cited

U.S. PATENT DOCUMENTS

| | | | |
|---|---|---|---|
| 3,297,400 | A | 1/1967 | Eastwood |
| 3,972,685 | A | 8/1976 | Hanaoka |

(Continued)

FOREIGN PATENT DOCUMENTS

| | | | |
|---|---|---|---|
| CN | 102562233 | A | 7/2012 |
| CN | 103527331 | A | 1/2014 |

(Continued)

OTHER PUBLICATIONS

English machine translation of EP2527611A1.*

(Continued)

*Primary Examiner* — Brandon D Lee

(74) *Attorney, Agent, or Firm* — Fletcher Yoder, P.C.

(57) ABSTRACT

An exhaust gas aftertreatment apparatus for an internal combustion engine, in particular a stationary internal combustion engine having at least one catalyst unit for exhaust gases, which is arranged downstream of the internal combustion engine. Exhaust gases from the internal combustion engine can be taken past the at least one catalyst unit by way of a bypass conduit, and the at least one catalyst unit and the bypass conduit are arranged in a common housing. The housing has at least two separate feed conduits for untreated exhaust gas and at least one outlet conduit for exhaust gas treated by the at least one catalyst unit.

17 Claims, 4 Drawing Sheets

(56) References Cited

U.S. PATENT DOCUMENTS

| | | | | |
|---|---|---|---|---|
| 5,195,316 | A * | 3/1993 | Shinzawa | F01N 3/027 60/274 |
| 5,277,026 | A * | 1/1994 | Boll | F01N 3/2006 422/171 |
| 5,325,666 | A | 7/1994 | Rutschmann | |
| 5,582,004 | A | 12/1996 | Rutschmann | |
| 6,370,872 | B1 | 4/2002 | Watanabe et al. | |
| 2005/0284139 | A1* | 12/2005 | Verkiel | F01N 3/0231 60/297 |
| 2006/0011152 | A1* | 1/2006 | Hayes | F01P 3/18 123/41.49 |
| 2006/0053771 | A1 | 3/2006 | Murata | |
| 2008/0041050 | A1* | 2/2008 | Doring | F01N 3/021 60/605.1 |
| 2010/0154411 | A1 | 6/2010 | Brueck et al. | |
| 2011/0000201 | A1* | 1/2011 | Laube | F01N 1/166 60/324 |
| 2013/0091830 | A1* | 4/2013 | Li | F01N 3/2892 60/295 |
| 2014/0007851 | A1 | 1/2014 | Vassallo et al. | |
| 2015/0176454 | A1 | 6/2015 | Dreves et al. | |
| 2015/0337706 | A1 | 11/2015 | Hillen | |

FOREIGN PATENT DOCUMENTS

| | | | | |
|---|---|---|---|---|
| DE | 44 31 058 | | 8/1995 | |
| DE | 4431058 | C1 | 8/1995 | |
| EP | 1 445 439 | A1 | 8/2004 | |
| EP | 2527611 | A1 * | 11/2012 | F01N 3/2066 |
| EP | 2671630 | A1 | 12/2013 | |
| EP | 2 687 696 | | 1/2014 | |
| JP | H0267021 | U | 5/1990 | |
| JP | 6-501759 | | 2/1994 | |
| JP | 7-54640 | | 2/1995 | |
| JP | 7-224641 | | 8/1995 | |
| JP | 07224641 | A | 8/1995 | |
| JP | 9-13958 | | 1/1997 | |
| JP | 0913958 | A | 1/1997 | |
| JP | 2004-197569 | | 7/2004 | |
| JP | 2004-211660 | | 7/2004 | |
| JP | 2004197569 | A | 7/2004 | |
| JP | 2005-61366 | | 3/2005 | |
| JP | 2005061366 | A | 3/2005 | |
| JP | 2005-248736 | A | 9/2005 | |
| JP | 2010242522 | A | 10/2010 | |
| JP | 2012-246920 | | 12/2012 | |
| WO | 2004113694 | A1 | 12/2004 | |
| WO | 2012/123636 | | 9/2012 | |
| WO | 2012123636 | A1 | 9/2012 | |
| WO | 2013/112101 | | 8/2013 | |
| WO | 2014/050179 | | 4/2014 | |

OTHER PUBLICATIONS

Search Report dated Nov. 25, 2015 in corresponding European Application No. 15 00 1908 with English translation.

Unofficial English Translation of Austrian Office Action issued in connection with corresponding AT Application No. A5722014 dated Jul. 10, 2015.

Unofficial English Translation of Japanese Search Report issued in connection with corresponding JP Application No. 2015130611 dated Jul. 20, 2016.

Unofficial English Translation of Chinese Office Action issued in connection with corresponding CN Application No. 201510430081.3 dated Apr. 20, 2017.

Notification of Reasons for Refusal issued in connection with corresponding JP Application No. 2015-130611 dated Mar. 27, 2018.

* cited by examiner

EXHAUST GAS AFTERTREATMENT APPARATUS

BACKGROUND OF THE INVENTION

The invention concerns an exhaust gas aftertreatment apparatus for an internal combustion engine.

Stationary internal combustion engines are frequently used for decentral power generation. They have up to 24 cylinders. The cylinders are generally disposed in two cylinder banks in a V-arrangement. Stationary internal combustion engines are frequently equipped with exhaust gas aftertreatment systems in order to comply with emission requirements. For example, oxidation devices in the form of oxidation catalysts are used to reduce the emission of unburnt hydrocarbons and carbon monoxide. Catalysts for selective catalytic reduction are frequently used for the reduction of nitrogen oxides. Systems for exhaust gas aftertreatment of stationary internal combustion engines therefore frequently include catalytically active assemblies, referred to hereinafter as catalyst units.

In operation of such catalyst units, it can be indicated that only a part of the exhaust gas mass flow from the internal combustion engine flows through the catalyst unit while the remaining part is passed around the catalyst unit by way of a bypass conduit. Temperature peaks in the exhaust gas downstream of the catalyst unit can be alleviated by that exhaust gas bypass. That is relevant in particular when the catalyst unit is arranged upstream of an exhaust gas turbocharger. Excessive exothermic phenomena occur for example in regeneration of the catalyst unit or when unburnt hydrocarbons break through, for example in the event of misfires. Another motivation for passing exhaust gas around the catalyst unit by way of a bypass is the occurrence of untreated emissions from the internal combustion engine, that are harmful to the catalyst unit, for example by virtue of operating with high-sulfur fuel.

Thus, WO 2012/123636 shows an arrangement of a stationary internal combustion engine having a catalyst unit 3 (here in the form of an oxidation device) which is set up upstream of the exhaust gas turbine 2. In accordance with that specification, the exhaust gas can be passed around the catalyst unit 3 by way of a bypass conduit 6 when using high-sulfur fuel.

In the case of exhaust gas aftertreatment apparatuses which are known from the state of the art for stationary internal combustion engines, having a bypass conduit, the bypass conduit is in the form of a pipe separate from the catalyst unit. No consideration is given to a structural form of the internal combustion engine. That entails a number of disadvantages: on the one hand, the structural configuration is complicated and expensive while on the other hand the exhaust gas which is passed by way of a bypass conduit does not contribute to heating the catalyst unit.

SUMMARY OF THE INVENTION

The object of the present invention is to provide an exhaust gas aftertreatment apparatus for an internal combustion engine, in which the disadvantages in the state of the art are avoided.

The fact that the at least one catalyst unit and the bypass conduit are arranged in a common housing, and the housing has at least two separate feed conduits for untreated exhaust gas and at least one outlet conduit for exhaust gas treated by the at least one catalyst unit therefore provides that a compact structural form is afforded for the exhaust gas aftertreatment apparatus and the exhaust gases which are passed through the bypass conduit contribute to heating the at least one catalyst unit.

Preferably, the separate feed conduits for untreated exhaust gas are respectively connected to a cylinder bank of the internal combustion engine. In that case, the exhaust gases from the internal combustion engine flow by way of the separate feed conduits for untreated exhaust gas into the exhaust gas aftertreatment apparatus in such a way that the exhaust gases from the one cylinder bank pass into the exhaust gas aftertreatment apparatus by the one separate feed conduit and the exhaust gases from the other cylinder bank pass into the exhaust gas aftertreatment apparatus through the second separate feed conduit. That takes account of the structural form of the internal combustion engine and a particularly compact structural form with simple integration is achieved.

In a further preferred embodiment, two separate catalyst units are arranged in the housing. It has been found to be desirable for the exhaust gas aftertreatment to be distributed to a plurality of separate catalyst units instead of providing a large catalyst unit. In that way, it is possible to use less expensive and smaller catalyst elements. A catalyst unit can be made up in modular form from catalyst elements.

Preferably, the amount of exhaust gas which flows away from the exhaust gas aftertreatment apparatus by way of the bypass conduit can be subjected to open-loop or closed-loop control by a first valve. That is intended to mean that the proportion of bypassed exhaust gas can be subjected to open-loop or closed-loop control by way of a valve disposed in the bypass conduit.

Alternatively or additionally, the amount of exhaust gas which flows away from the exhaust gas aftertreatment apparatus by way of the catalyst unit can be subjected to open-loop or closed-loop control by a second valve. That means that the proportion of bypassed exhaust gas can be subjected to open-loop or closed-loop control by way of a second valve arranged in the flow path of the exhaust gases treated in the catalyst unit.

BRIEF DESCRIPTION OF THE DRAWINGS

The invention is described in greater detail hereinafter by reference to the Figures in which.

DETAILED DESCRIPTION OF THE INVENTION

Figure 1:
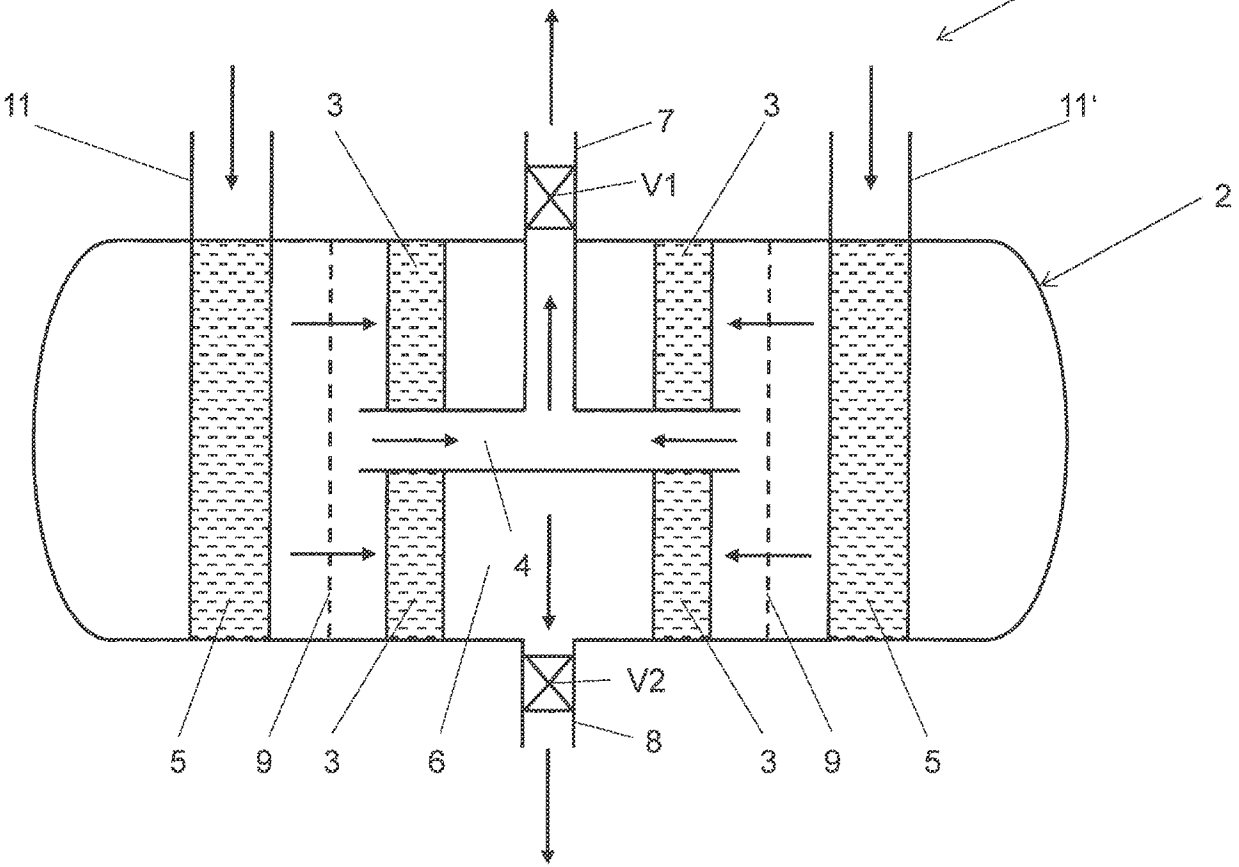
FIG. 1 shows an exhaust gas aftertreatment apparatus according to the invention.

FIG. 1 diagrammatically shows a cross-section of an exhaust gas aftertreatment apparatus 1. It is possible to see the separate feed conduits 11, 11' by way of which untreated exhaust gas passes into the exhaust gas aftertreatment apparatus 1. Optionally, the exhaust gas flows through a mixing device 5. Subsequently, the exhaust gas passes through a flow equalization device (also optional) and reaches a catalyst unit 3. As shown in FIG. 1, each of the first feed conduit 11 and the second feed conduit 11' leads to a separate respective catalyst unit 3 within the housing 2. When the valve V1 is open, the exhaust gas flows through a bypass conduit 4 and leaves the exhaust gas aftertreatment apparatus 1 by way of the first outlet conduit 7. For complete bypass, the valve V2 remains closed.

When the valve V1 is closed and the valve V2 is open, the exhaust gas flows into the chamber 6 by way of the second catalyst unit 3 and leaves the exhaust gas aftertreatment apparatus 1 by way of the second outlet conduit 8. It will be appreciated that in practice the illustrated apparatus can also be operated in such a way that the valves V1 and V2 are not only held in their completely open or completely closed position, but both valves V1 and V2 are partially opened so that only a part of the exhaust gas mass flow flows through the bypass conduit 4.

It will be seen that the catalyst units 3 and the bypass conduit 4 are arranged in a common housing 2. The outlet conduits 7 and 8 are generally combined after issuing from the exhaust gas aftertreatment apparatus 1 and are brought together to form an exhaust gas conduit. That detail is not shown here.

Figure 2:
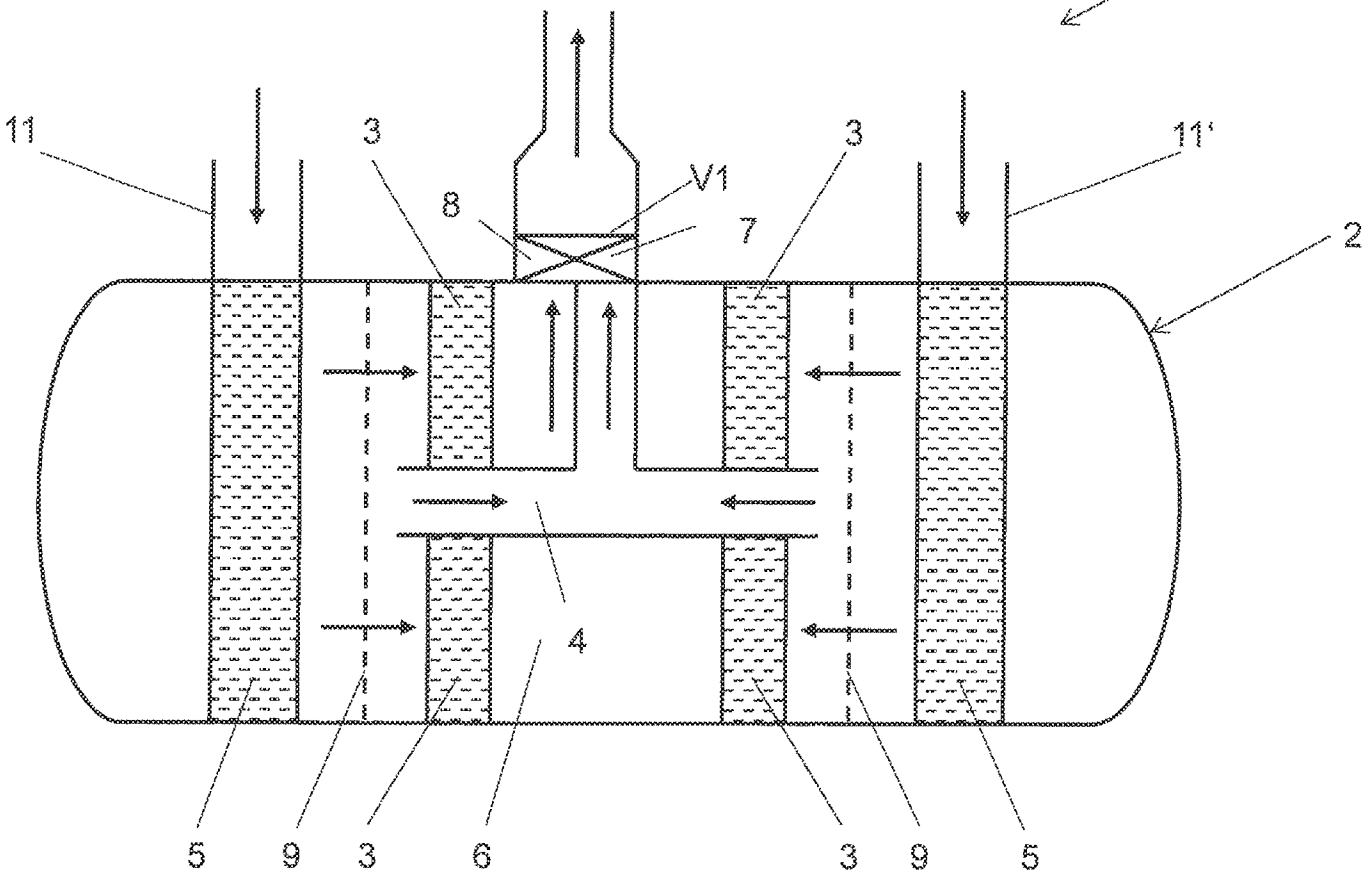
FIG. 2 shows an exhaust gas aftertreatment system in an alternative embodiment.

FIG. 2 shows an alternative embodiment of an exhaust gas aftertreatment apparatus 1. In this case, the valve V1 is in the form of a switching device which selectively opens or closes the first outlet conduit 7 for exhaust gas treated in the catalyst unit 3 and the second outlet conduit 8 for exhaust gas which is passed by way of the bypass conduit 4, respectively. In that way, both flow paths 7 and 8 can be switched by only one component. The switching device can be for example in the form of a rotary slider or in the simplest case in the form of a flap. The outlet conduits 7 and 8 are preferably brought together downstream of the switching device to constitute a conduit line. In that way, the exhaust gas aftertreatment apparatus 1 can have a particularly compact structure with simple control members.

Figure 3:
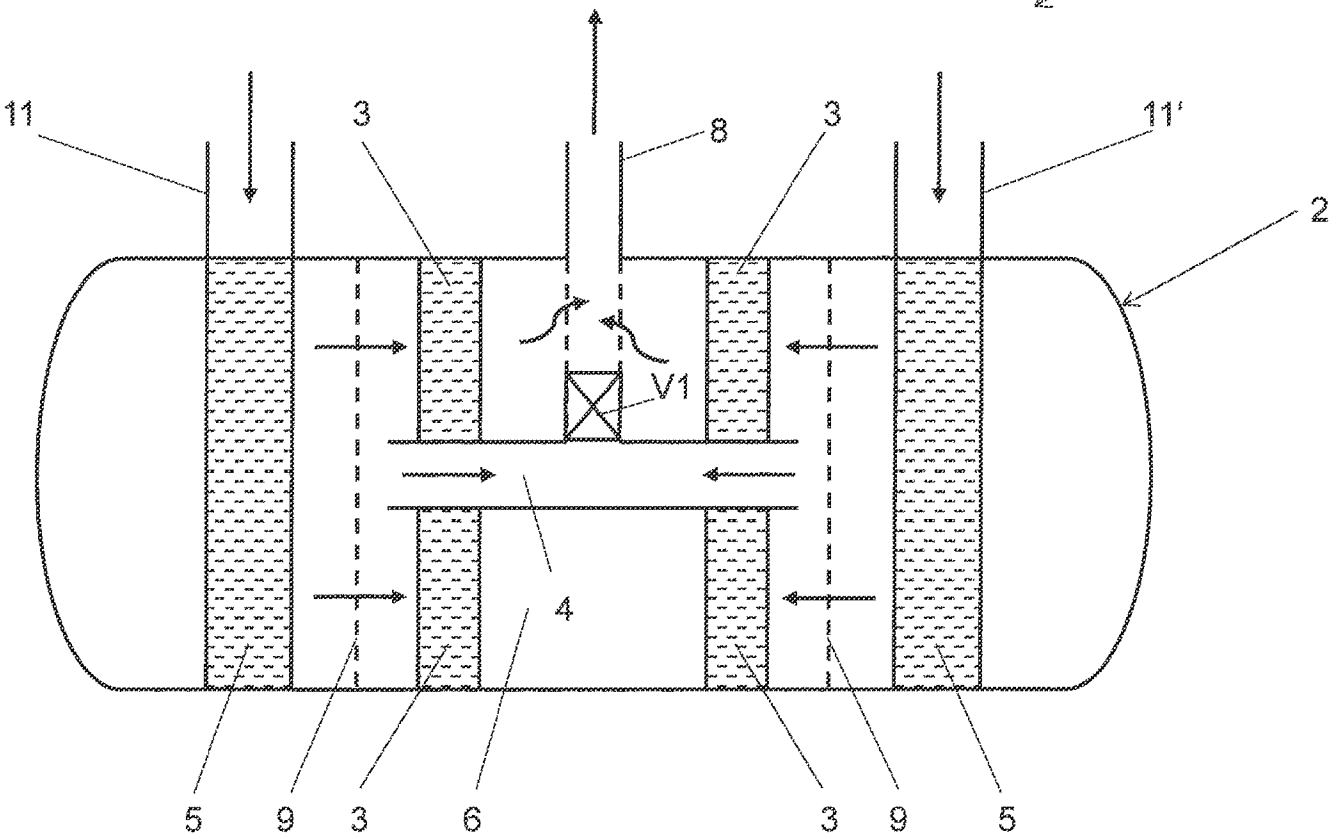
FIG. 3 shows an exhaust gas aftertreatment system in an alternative embodiment.

FIG. 3 shows a further alternative embodiment of an exhaust gas aftertreatment apparatus 1. Here the valve V1 is so arranged that, when the valve V1 is closed, the exhaust gases issue through the catalyst unit 3 and finally through the outlet conduit 8 from the exhaust gas aftertreatment apparatus 1. That can be implemented for example by the outlet conduit 8, in a portion thereof which is in the interior of the housing 2, having a perforation, that is to say orifices, through the exhaust gas post-treated by the catalyst unit 3 can pass. When the valve V1 is open, the exhaust gases, by virtue of the lower flow resistance, preferably adopt the path through the bypass conduit 4 and issue untreated through the outlet conduit 8. This variant therefore provides a possible way of determining with just one valve (valve V1) whether the exhaust gases for the bypass conduit 4 and finally the outlet conduit 8 issue untreated from the exhaust gas aftertreatment apparatus 1, or whether the exhaust gases treated by the catalyst unit 3 issue from the exhaust gas aftertreatment apparatus 1 by way of the outlet conduit 8.

Figure 4:
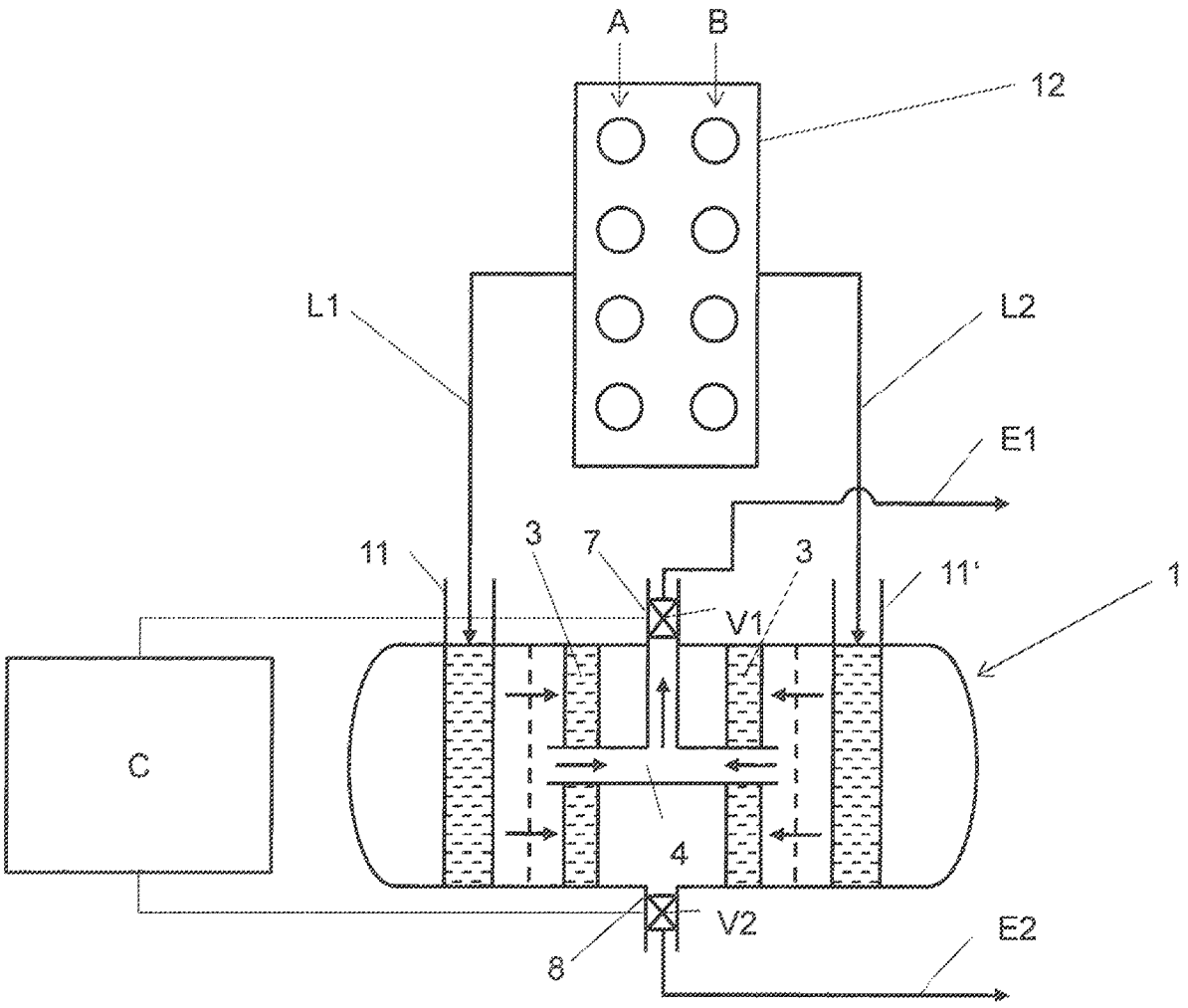
FIG. 4 shows an arrangement of an internal combustion engine with associated exhaust gas aftertreatment apparatus.

FIG. 4 shows an arrangement comprising an exhaust gas aftertreatment apparatus 1, an internal combustion engine 12 and an open-loop/closed-loop controller C. The arrangement shows by way of example an exhaust gas aftertreatment apparatus 1 in accordance with the embodiment of FIG. 1. It will be appreciated that the exhaust gas aftertreatment apparatus 1 can be designed in accordance with any other embodiment. The cylinder banks of the internal combustion engine 12 are denoted by references A and B. The cylinder bank A includes the cylinders of the one cylinder bank while cylinder bank B includes the cylinders of the other cylinder bank. The cylinder bank A is connected by way of the exhaust gas conduit L1 with the intake conduit 11 to the exhaust gas aftertreatment apparatus 1. The cylinder B is connected by way of the exhaust gas conduit L2 with the intake conduit 11' to the exhaust gas aftertreatment apparatus 1. In operation, the valves V1, V2 receive commands for opening and closing from the open-loop/closed-loop controller C. The open-loop/closed-loop controller C is adapted so that information relating to engine parameters, exhaust gas temperatures, optionally component temperatures can be fed thereto and processed. The associated sensors and signal lines are not shown and are of a configuration as is familiar to the man skilled in the art.

In the variant shown in FIG. 1 of the exhaust gas aftertreatment apparatus 1 with two valves V1, V2, opening of the valve V1, with the valve V2 closed, therefore provides that all exhaust gases issue from the exhaust gas aftertreatment apparatus 1 through the bypass conduit 4. Conversely, a completely closed valve V1, with the valve V2 open, means that all exhaust gases issue from the exhaust gas aftertreatment apparatus 1 when post-treated by the catalyst unit 3. It will be appreciated that, by way of a variation in the open conditions of the valves V1, V2, it is also possible to achieve a variation in the exhaust gas mass flows passing through the bypass conduit 4 and through the catalyst unit 3, respectively. As described with reference to FIG. 2 the exhaust gas aftertreatment apparatus 1 can also be operated with only one valve.

LIST OF REFERENCES USED

1 exhaust gas aftertreatment apparatus
2 housing
3 catalyst unit
4 bypass conduit
5 mixing device
6 chamber
7 outlet conduit from bypass
8 outlet conduit from chamber
9 flow equalization device
11, 11' feed conduits
12 internal combustion engine
A, B cylinder banks
C open-loop/closed-loop controller
L1, L2 exhaust gas conduits
E1, E2 outlet conduits
V1, V2 valves

The invention claimed is:

1. An exhaust gas aftertreatment apparatus to be arranged downstream of an internal combustion engine, the exhaust gas aftertreatment apparatus comprising:

a housing;

a first catalyst unit within the housing;

a second catalyst unit within the housing;

at least two separate feed conduits each configured to supply an exhaust gas from the internal combustion engine, with a first conduit of the at least two separate feed conduits supplying the first catalyst unit and a second conduit of the at least two separate feed conduits supplying the second catalyst unit, for each feed conduit leading to a separate catalyst unit;

a chamber within the housing arranged between the first catalyst unit and the second catalyst unit;

an outlet conduit arranged between the at least two separate feed conduits and connected to the chamber, wherein the outlet conduit is configured to guide the exhaust gas treated by the first catalyst unit and the second catalyst unit out of the housing; and a bypass conduit, arranged within the housing extending between the at least two separate feed conduits and configured to guide the exhaust gas from the internal combustion engine, bypassing the first catalyst unit and the second catalyst unit, to the outlet conduit such that the exhaust gas is not catalytically treated in the bypass conduit, wherein the exhaust gas treatment apparatus is configured to flow the exhaust gas through the housing at least partially about an exterior of the bypass conduit.

2. The exhaust gas aftertreatment apparatus as set forth in claim 1, wherein each of the at least two separate feed conduits is connected to a respective one of at least two cylinder banks of the internal combustion engine.

3. The exhaust gas aftertreatment apparatus as set forth in claim 1, further comprising a control valve for open-loop or closed-loop control of an amount of exhaust gas flowing through the bypass conduit.

4. The exhaust gas aftertreatment apparatus as set forth in claim 3, wherein the control valve is a first control valve, further comprising a second control valve for open-loop or closed-loop control of an amount of exhaust gas flowing through the first catalyst unit and the second catalyst unit.

5. The exhaust gas aftertreatment apparatus as set forth in claim 4, further comprising a controller configured to control the first control valve and the second control valve to perform the open-loop or closed-loop control.

6. The exhaust gas aftertreatment apparatus as set forth in claim 3, further comprising a controller configured to control the control valve to perform the open-loop or closed-loop control.

7. The exhaust gas aftertreatment apparatus as set forth in claim 1, further comprising a control valve for open-loop or closed-loop control of an amount of exhaust gas flowing through the first catalyst unit and the second catalyst unit.

8. The exhaust gas aftertreatment apparatus as set forth in claim 7, further comprising a controller configured to control the control valve to perform the open-loop or closed-loop control.

9. The exhaust gas aftertreatment apparatus as set forth in claim 1, further comprising mixers within the housing, wherein the mixers are configured to mix the exhaust gas supplied by the at least two separate feed conduits prior to supply of the exhaust gas to at least one of the first catalyst unit and the second catalyst unit.

10. A system, comprising:

an exhaust gas treatment apparatus, comprising:

a housing;

a first treatment flow path through the housing, wherein the first treatment flow path comprises a first catalyst section configured to treat an exhaust gas flowing through the housing;

a second treatment flow path through the housing, wherein the second treatment flow path comprises a second catalyst section configured to treat the exhaust gas flowing through the housing;

a bypass flow path through the housing, wherein the bypass flow path excludes catalytic treatment of the exhaust gas flowing through the housing wherein the bypass flow path extends through a first bypass conduit disposed in a first opening in the first catalyst section, and a second bypass conduit disposed in a second opening in the second catalyst section, wherein the first and second bypass conduits couple to a common conduit in a chamber between the first and second catalyst sections within the housing, wherein the exhaust gas treatment apparatus comprises one of:

the housing having first and second exhaust outlets, wherein the common conduit is coupled to the first exhaust outlet, and the chamber is coupled to the second exhaust outlet; or the common conduit and the chamber are coupled to a common exhaust outlet of the housing.

11. The system of claim 10, comprising a combustion engine having at least one exhaust outlet coupled to the exhaust gas treatment apparatus.

12. The system of claim 10, wherein the exhaust gas treatment apparatus comprises at least one valve configured to control relative amounts of the exhaust gas flowing through the housing along the first treatment flow path, the second treatment flow path, and the first bypass flow path.

13. The system of claim 12, wherein the at least one valve is coupled to the bypass flow path, or the first and second treatment flow paths, or the bypass flow path and the first and second treatment flow paths.

14. The system of claim 10, wherein the housing comprises the first and second exhaust outlets, the common conduit is coupled to the first exhaust outlet, and the chamber is coupled to the second exhaust outlet.

15. The system of claim 10, wherein the common conduit and the chamber are coupled to the common exhaust outlet of the housing.

16. A system, comprising:

an exhaust gas treatment apparatus, comprising:

a housing comprising a first exhaust inlet coupled to a first chamber, a second exhaust inlet coupled to a second chamber, and at least one exhaust outlet coupled to a third chamber between the first and second chambers;

a first catalyst section disposed in the housing between the first and third chambers;

a second catalyst section disposed in the housing between the second and third chambers;

a first bypass conduit extending through a first opening in the first catalyst section between the first and third chambers; and a second bypass conduit extending through a second opening in the second catalyst section between the second and third chambers, wherein the exhaust gas treatment apparatus is configured to flow an exhaust gas through the housing at least partially about an exterior of the first and second bypass conduits, wherein the exhaust gas treatment apparatus is configured to catalytically treat the exhaust gas in the first and second catalyst sections and not catalytically treat the exhaust gas in the first and second bypass conduits.

17. The system of claim 16, wherein the first and second bypass conduits are coupled to a common conduit in the third chamber.

* * * * *